US006526694B1

(12) United States Patent
Cosgrove

(10) Patent No.: US 6,526,694 B1
(45) Date of Patent: Mar. 4, 2003

(54) TWO PORTION FRAME FOR SUPPORTING DOORS AND THE LIKE

(75) Inventor: John James Cosgrove, Clane (IE)

(73) Assignee: Perbrisu Limited, Clane (IE)

( * ) Notice: Subject to any disclaimer, the term of this patent is extended or adjusted under 35 U.S.C. 154(b) by 0 days.

(21) Appl. No.: 09/446,792

(22) PCT Filed: Jun. 29, 1998

(86) PCT No.: PCT/IE98/00055

§ 371 (c)(1),
(2), (4) Date: Dec. 23, 1999

(87) PCT Pub. No.: WO99/00569

PCT Pub. Date: Jan. 7, 1999

(30) Foreign Application Priority Data

Jun. 27, 1997 (IE) ..... S970479
Nov. 11, 1997 (IE) ..... S970802

(51) Int. Cl.[7] ..... E05B 65/06; E05D 15/54
(52) U.S. Cl. ..... 49/67; 49/163; 49/169
(58) Field of Search ..... 49/61, 63, 67, 49/65, 62, 142, 163, 169

(56) References Cited

U.S. PATENT DOCUMENTS 706,449 A * 8/1902 Peppers ..... 49/63
712,449 A * 10/1902 Young ..... 211/4
1,263,248 A * 4/1918 Hope ..... 49/62
1,391,133 A * 9/1921 Matchette ..... 49/67
1,581,776 A * 4/1926 Altschul ..... 211/4
1,587,658 A * 6/1926 Laycock ..... 160/91
1,661,554 A * 3/1928 Banta ..... 49/62
1,859,974 A * 5/1932 Kroenke ..... 160/97
1,934,546 A * 11/1933 Lewerentz ..... 49/62
2,286,899 A * 6/1942 Crescentini ..... 160/37
2,568,130 A * 9/1951 Olson ..... 49/62
2,622,283 A * 12/1952 Roos ..... 49/67
2,759,227 A * 8/1956 Reid et al. ..... 160/116
3,226,776 A * 1/1966 Van Wormer ..... 49/70
3,382,611 A * 5/1968 Zandelin ..... 49/67
3,947,997 A * 4/1976 Mursula ..... 49/62
4,302,907 A * 12/1981 Canals et al. ..... 49/65
4,389,817 A * 6/1983 Olberding ..... 49/163
4,583,382 A * 4/1986 Hull ..... 70/107
4,891,906 A * 1/1990 Knapp ..... 49/65
4,912,877 A * 4/1990 Strydom ..... 49/171
5,535,550 A * 7/1996 Yang ..... 49/163

* cited by examiner

*Primary Examiner*—Gregory J. Strimbu
(74) *Attorney, Agent, or Firm*—Hoffman & Baron, LLP

(57) ABSTRACT

A two portion frame for an opening (10) comprises a fixed frame portion (12), which is secured about the opening (10); a removable frame portion (22), which is hinged to the fixed frame portion (12) by hinges (30) and locks (36) by which the removable frame portion (22) is fixable to the fixed portion (12), so that the removable frame portion is removable only from one side of the frame. A door (32) is hinged to the removable frame portion (22) by hinges (34) so that it opens towards the other side. One or more locks are provided to lock the door (32) with the removable frame portion (22) and one or more locks are provided to lock the removable frame portion (22) with the fixed frame portion (12).

15 Claims, 12 Drawing Sheets

TWO PORTION FRAME FOR SUPPORTING DOORS AND THE LIKE

BACKGROUND OF THE INVENTION

The invention relates to doors and to door frames.

Door frames are secured about an opening in a wall, fencing or panel of secured area in buildings, containers and compounds. A door is usually hinged to the frame on one side of the frame and secured by a suitable lock on the opposite side. If the door is opened or closed by pushing or pulling, the door rotates about the axis of the hinges.

In the event that the lock is immobilized on one side to prevent ingress/exit through the door from the other side, the area is secured from interference from the other side. In most circumstances this may not be a major problem except in the case of prisons or other custodial or similar buildings where the authority to open/close doors must be in the hands of the custodians. Where this authority is denied to the custodians then a means of over-riding that denial needs to be obtained.

Currently, in a prison if the lock has been damaged or the door is barricaded from the inside then the only way to gain access to the unit having the inaccessible door is to remove the door stops on the frame and the lock fixed to the door. The door stops are usually screwed to the door frame and the lock is secured to the door by a number of bolts. However, this removal process is a difficult and time consuming job and cannot be achieved without generating noise so that the persons at the other side of the damaged door are always aware when remedial action is being taken.

A similar problem arises, when a person is locked in a cold room or in a secured room in a bank or the like. In this case, the door needs to be opened from the inside, while it is locked from the outside.

SUMMARY OF THE INVENTION

It is the object of the invention to overcome the above disadvantage.

In this way the frame can be removed or opened from the side of the custodians, if the door is immobilized.

BRIEF DESCRIPTION OF THE DRAWINGS

The invention will hereinafter be more particularly described with reference to the accompanying drawings which show, by way of example only, a number of embodiments according to the invention. In the drawings.

DETAILED DESCRIPTION OF THE INVENTION

Figure 1:
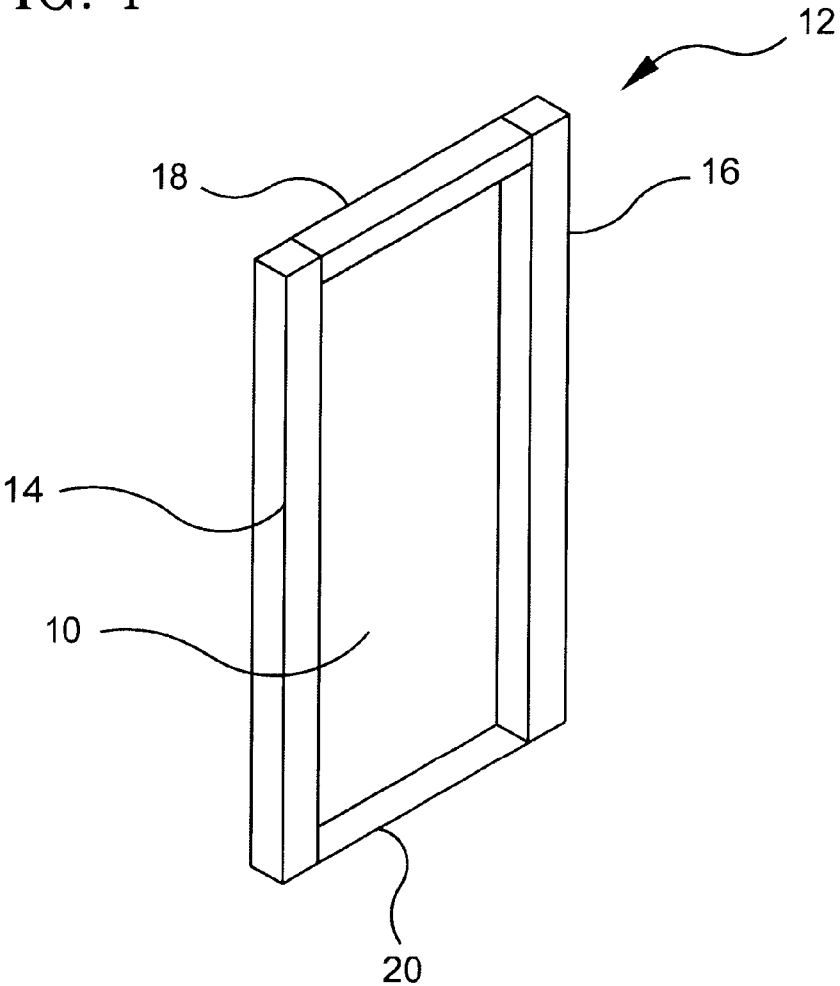
FIG. 1 is a pictorial view of a fixed frame portion.

In FIG. 1, numeral 10 denotes a door opening. The door opening 10 is defined by a frame portion 12 fixed to the wall (not shown). The frame portion 12 consists of two vertical members 14 and 16 and a horizontal member 18 jointed at the bottom by a member 20.

Figure 2:
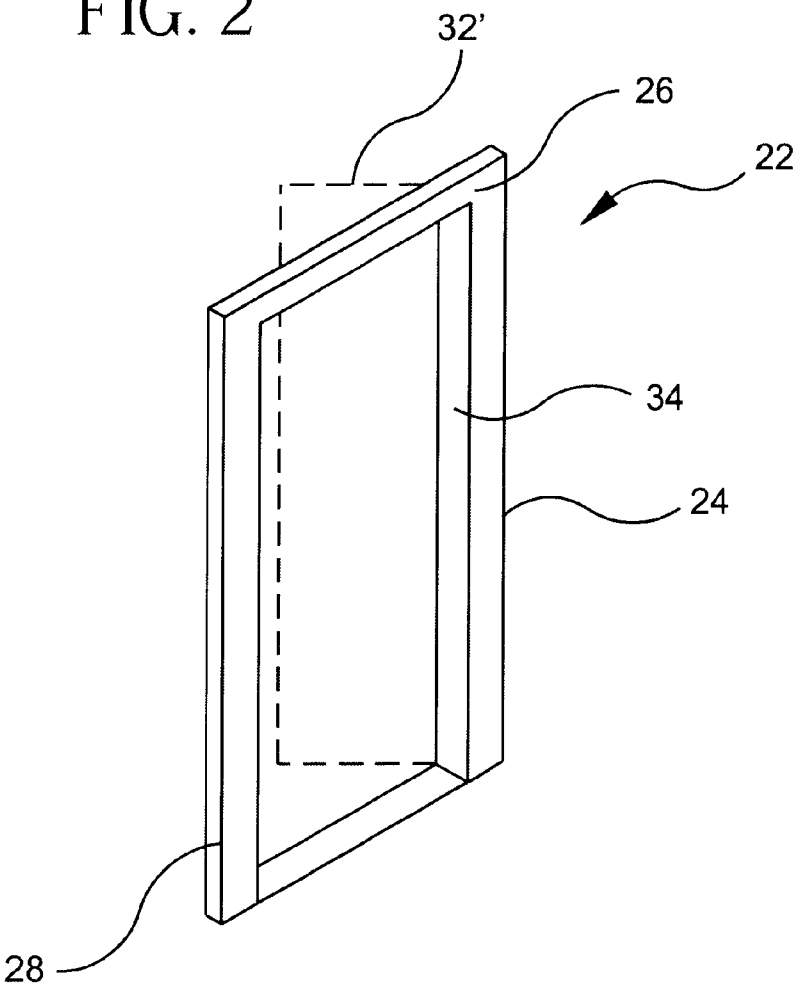
FIG. 2 is a pictorial view of a removable frame portion of L-shaped cross section with a hinged door.
Figure 3:
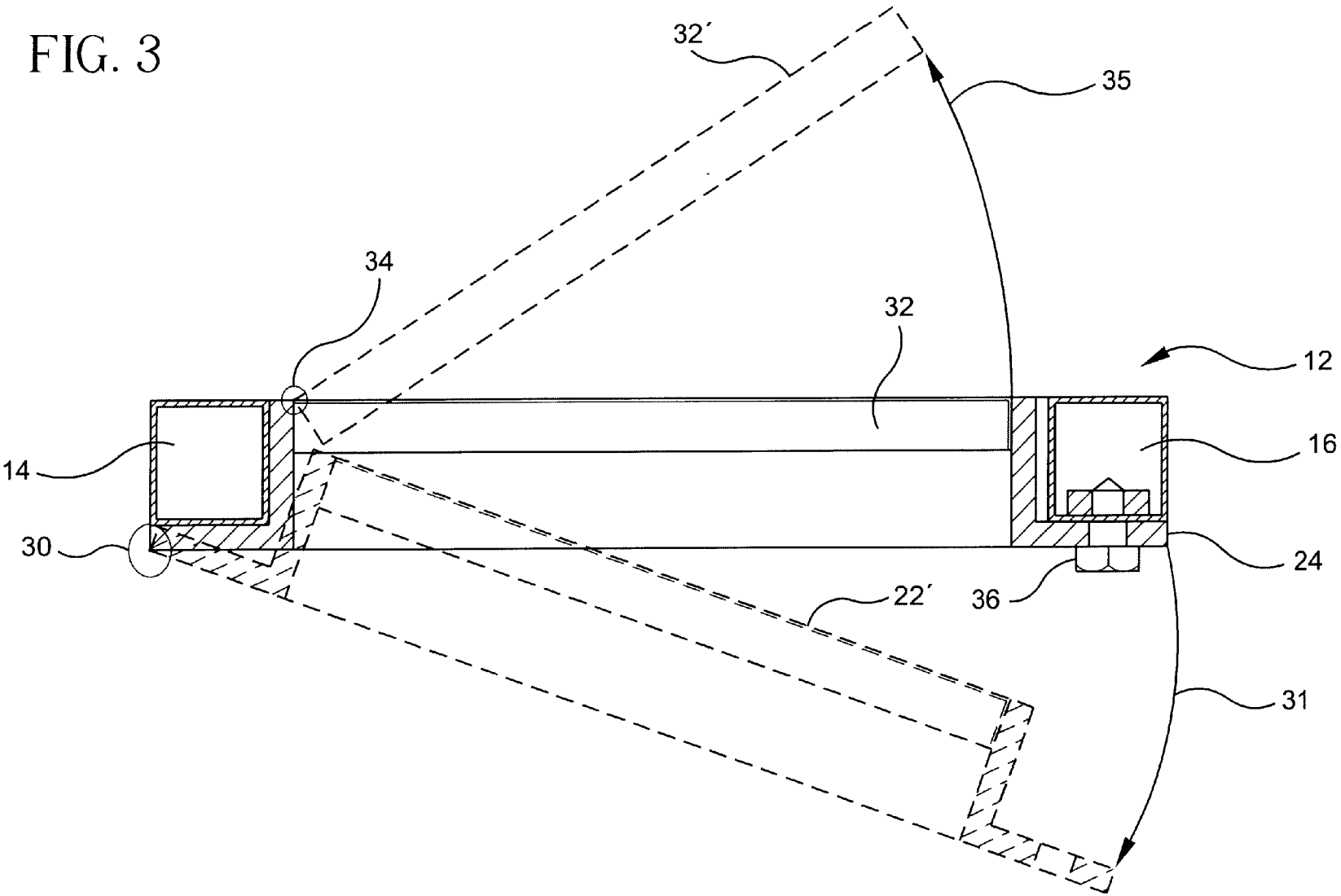
FIG. 3 shows a sectional plan view of the complete assembly of FIG. 1 and FIG. 2.

A second removable frame portion 22 is shown in FIG. 2. The removable frame portion 22 comprises three sides 24, 26 and 28 with a L-shaped cross section. The size of the removable frame portion 22 is designed so that it matches the fixed frame portion 12. The removable frame portion 22 can be hinged to the fixed frame portion 12 with hinges 30 as can be seen in the cross sectional view in FIG. 3. The axis of the hinges 30 vertically extends along the outside of the frame to on the custodians' side of the wall. Therefore the removable frame portion 22 can be moved through angle 31 towards the custodian's as can be seen in the opened position 22' of the frame portion 22.

The removable frame portion 22 carries a door 32 by means of hinges 34. The axis of the hinges 34 vertically extends along the inside of the removable frame portion 22 on the opposite of the custodians' side of the wall. Therefore the door opens towards the opposite side of the custodians in the direction of the arrow 35.

A locking bolt 36 is provided at the removable frame portion 22 in order to fasten the removable frame portion 22 to the fixed frame portion 12. A key operated lock (not shown) is provided at the door in order to lock the door to the removable frame portion 22.

Figure 5:
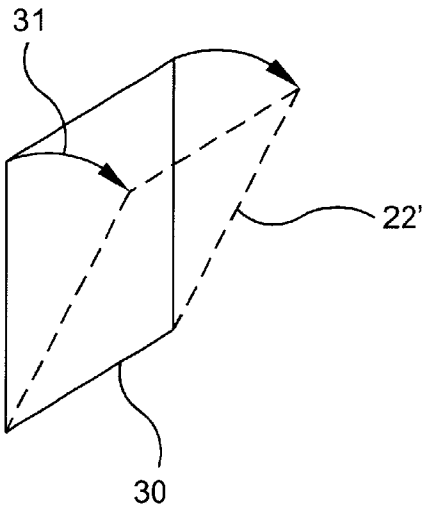
FIG. 5 is a schematic illustration of the removable frame portion being rotated about a horizontal hinge axis on the bottom of the frame.
Figure 4:
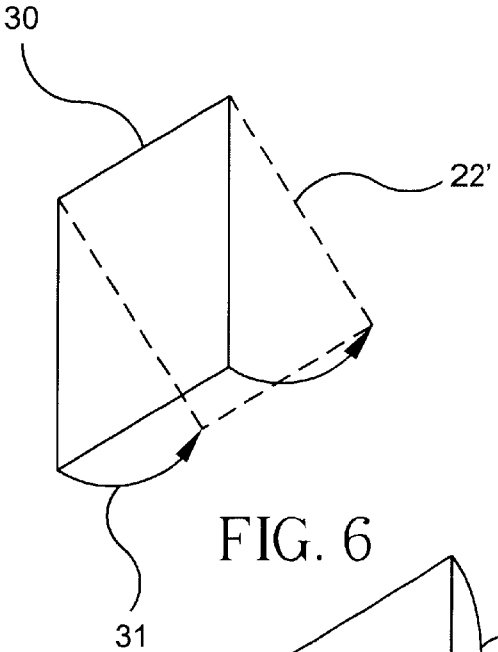
FIG. 4 is a schematic illustration of the removable frame portion being rotated about a horizontal hinge axis on the top of the frame.

The hinge axis of hinges 30 does not necessarily have to be arranged vertically. In FIG. 4 and FIG. 5 different embodiments are illustrated of the horizontal hinge axis of hinges 30. In FIG. 4 the hinge axis extends along the top of the door opening 10, so that the removable frame portion 22 has to be lifted through angle 31. In FIG. 5 the hinge axis extends along the bottom of the door opening, so that the removable frame portion 22 moves down through angle 31.

Figure 7:
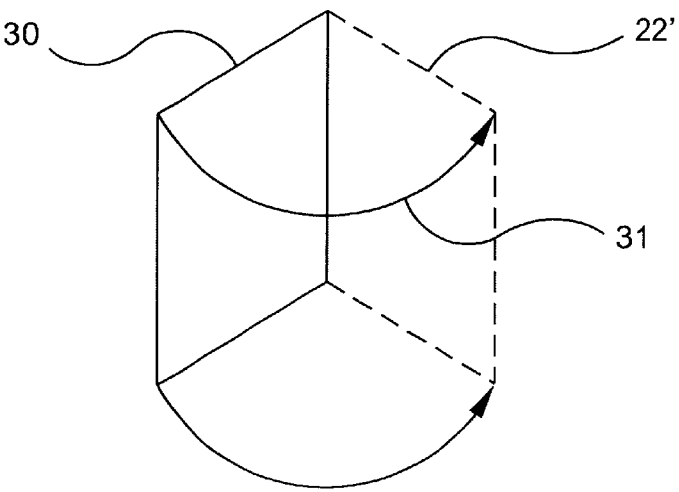
FIG. 7 is a schematic illustration of the removable frame portion being rotated about a vertical hinge axis on the right side of the frame.
Figure 6:
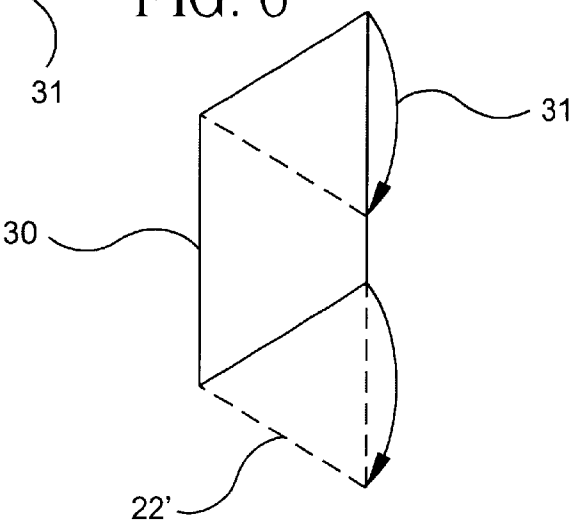
FIG. 6 is a schematic illustration of the removable frame portion being rotated about a vertical hinge axis on the left side of the frame.

FIG. 6 and FIG. 7 illustrate vertical hinge axis of hinges 30 on the right and left side respectively of the door opening 10. In these cases the removable frame portions 22 can be opened like a door.

Figure 8:
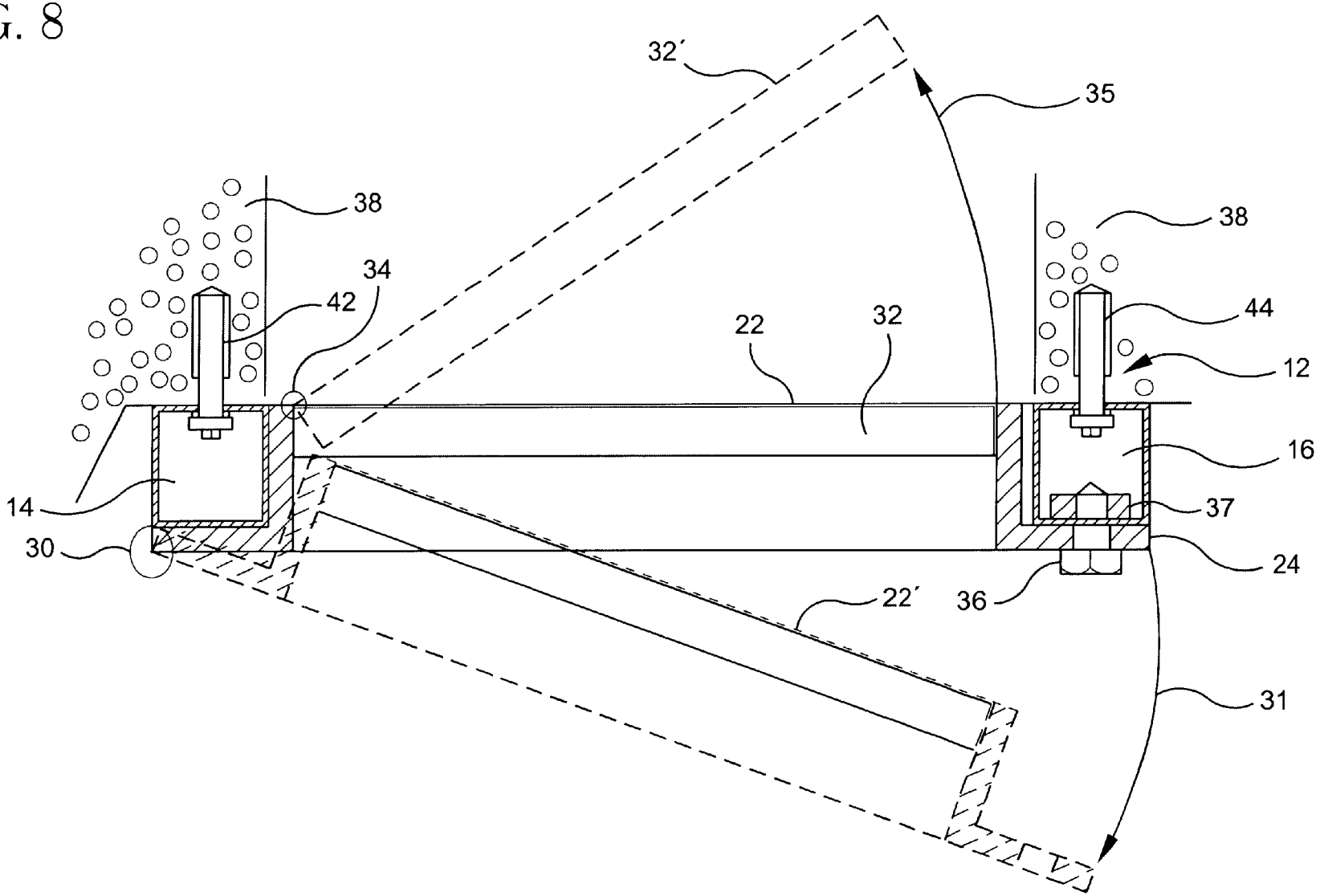
FIG. 8 is a cross-schematic plan view of the frame assembly of FIG. 1 to FIG. 3 bolted to a wall.

In FIG. 8 it is demonstrated, how the fixed frame portion 12 is bolted to the wall 38 by means of bolts 42 and 44. A locking bolt 36 is provided to lock the removable frame portion 22 with the fixed frame portion 12. The head of the bolt 36 is of a non-standard shape which can only be engaged by a complementary shaped spanner which is normally kept stored in a secure place.

Springs 37 are arranged at the locking bolt 36, as can be seen in FIG. 8. The springs 37 are biased in such a way, that the removable frame portion opens by their force as soon as the bolt 36 is turned by a minimum angle. The access to the other side of the door can therefore be obtained very quickly and without generating noise.

Numeral 32' indicates the door in an opened position and numeral 22' indicates the door in a closed position with the removable frame portion in an opened position.

Figure 9:
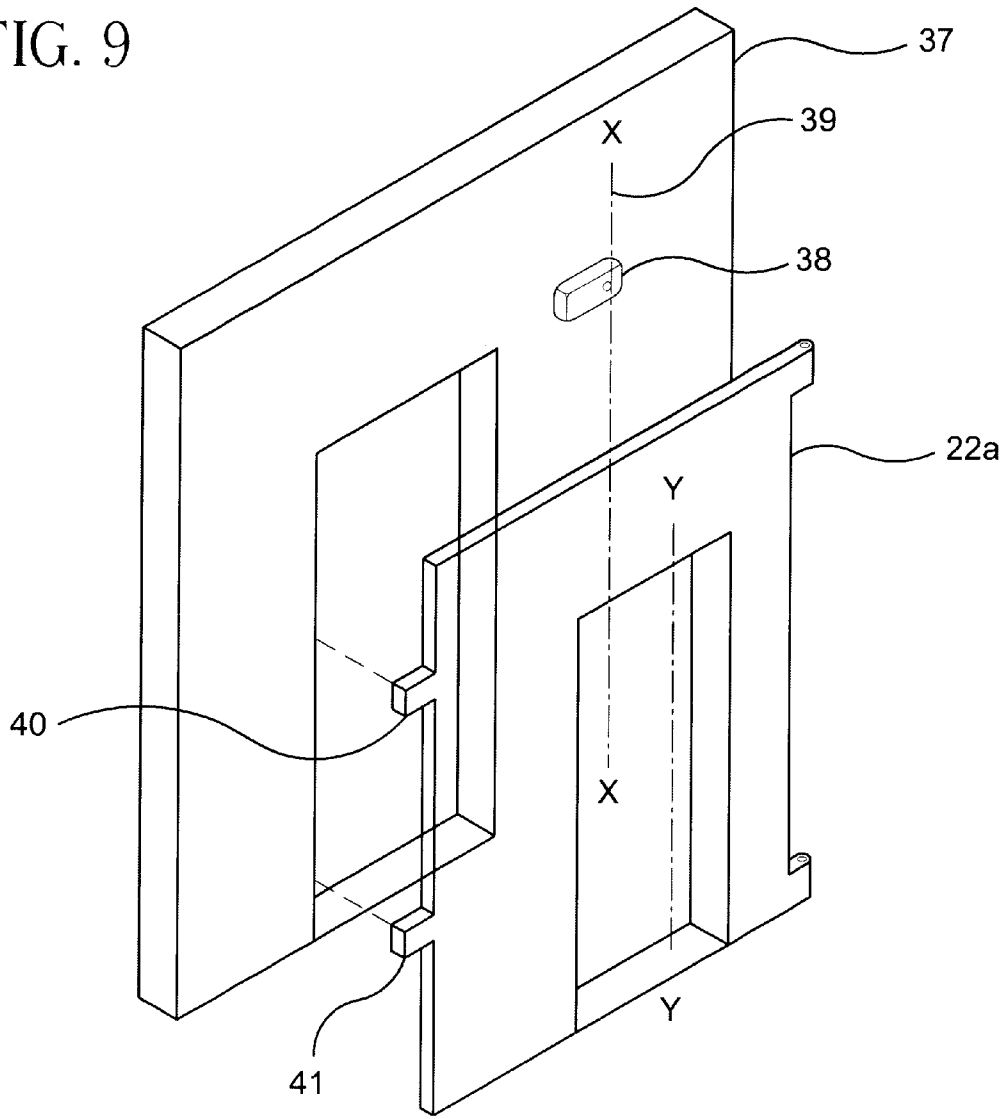
FIG. 9 is an exploded pictorial view of a second embodiment of the invention showing a removable frame portion and a section of a wall with a door opening.

In FIG. 9 an embodiment which slightly varies from the embodiment illustrated in FIGS. 1 to 3 and FIG. 8 is shown. Here the removable frame portion 22*a* is a flat piece of material with an opening for the door. It is mounted directly on the wall 38 with a hinge sash 38. The hinge axis 39 vertically extends along the wall on the side of the custodians. Therefore the removable frame portion 22*a* can be moved towards the custodians. The fixed frame portion 12 is defined by the wall 38.

Locking means 40, 41 are provided at the opposite side of the hinge axis 39 in order to lock the removable frame portion 22 to the wall 38.

Figure 10:
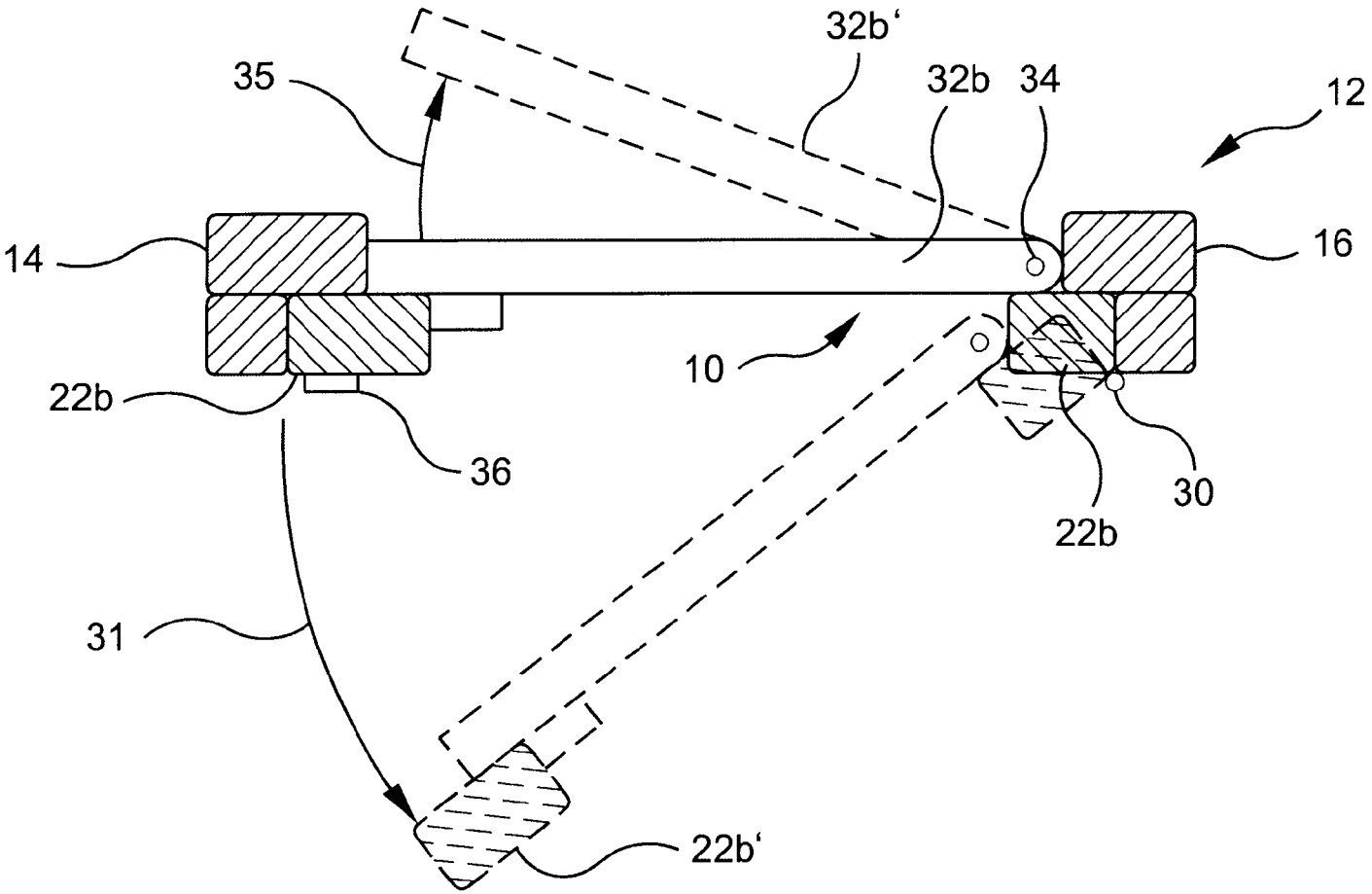
FIG. 10 is a cross section plan view through a third embodiment of the invention.

In the cross sectional view of FIG. 10 another embodiment of the invention is illustrated in which the removable frame portion 22*b* has a rectangular cross section member at its periphery. The removable frame portion 22*b* extends beyond the door opening 10 of the fixed frame portion 12. The two frame portions 12 and 22*b* are hinged with a hinge axis of hinges 30 at the wall side of the custodians. A door 32*b* is hinged to the removable frame portion 22*b* with a vertical hinge axis of hinges 34 inside the door opening. The size of the door 32*b* matches the door opening 10 of the fixed frame portion 12. The door 32*b* opens to the opposite side of the custodians in the direction of the arrow 35. The door is indicated by dotted lines 32*b'*.

Figure 12:
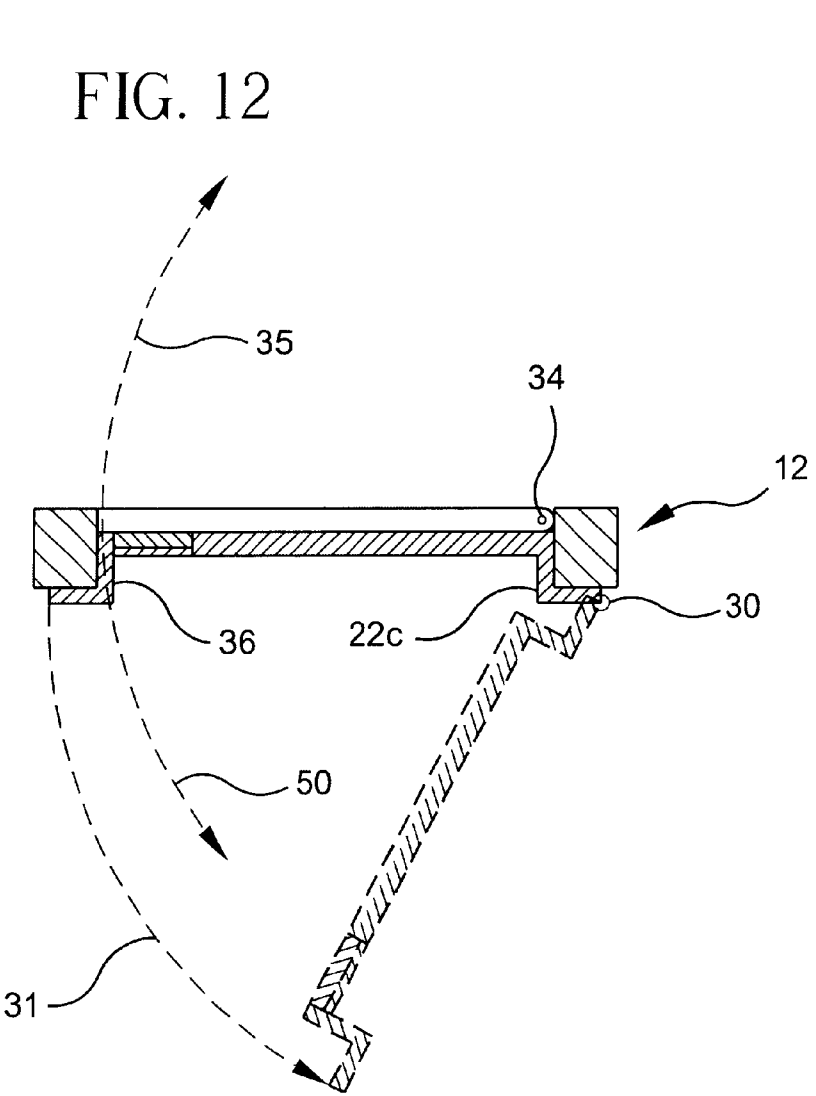
FIG. 12 is a cross sectional view of the embodiment of FIG. 11.
Figure 11:
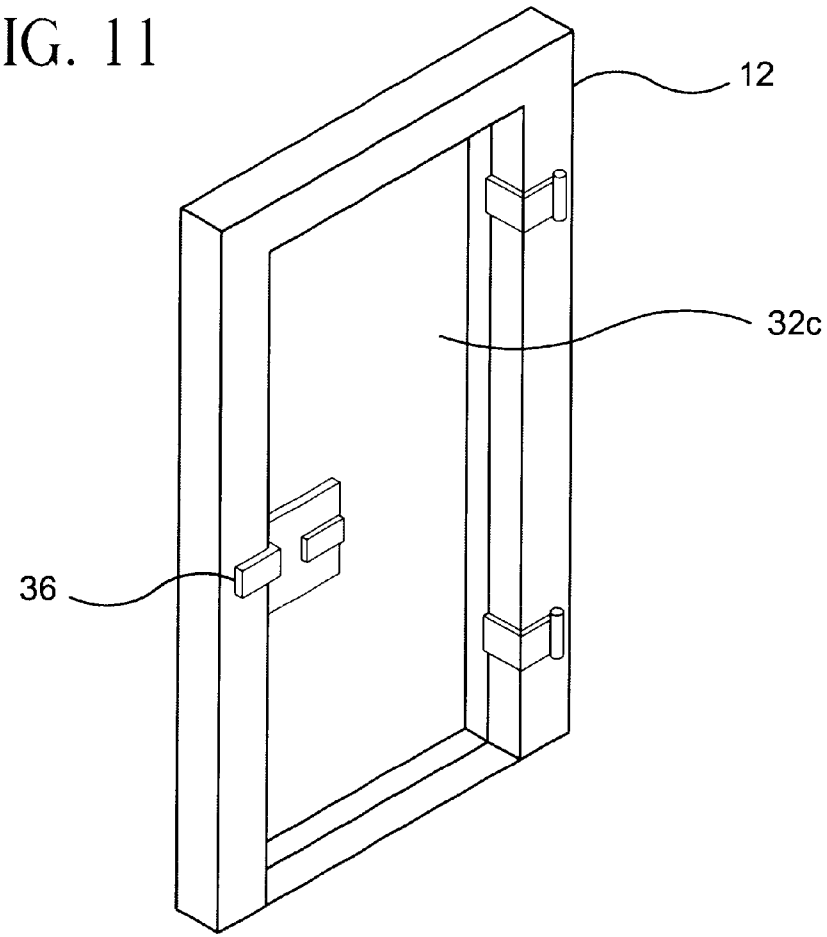
FIG. 11 is a pictorial view of a fourth embodiment of the invention in which a door is hinged to a fixed frame portion and can be opened in both directions.
Figure 13:
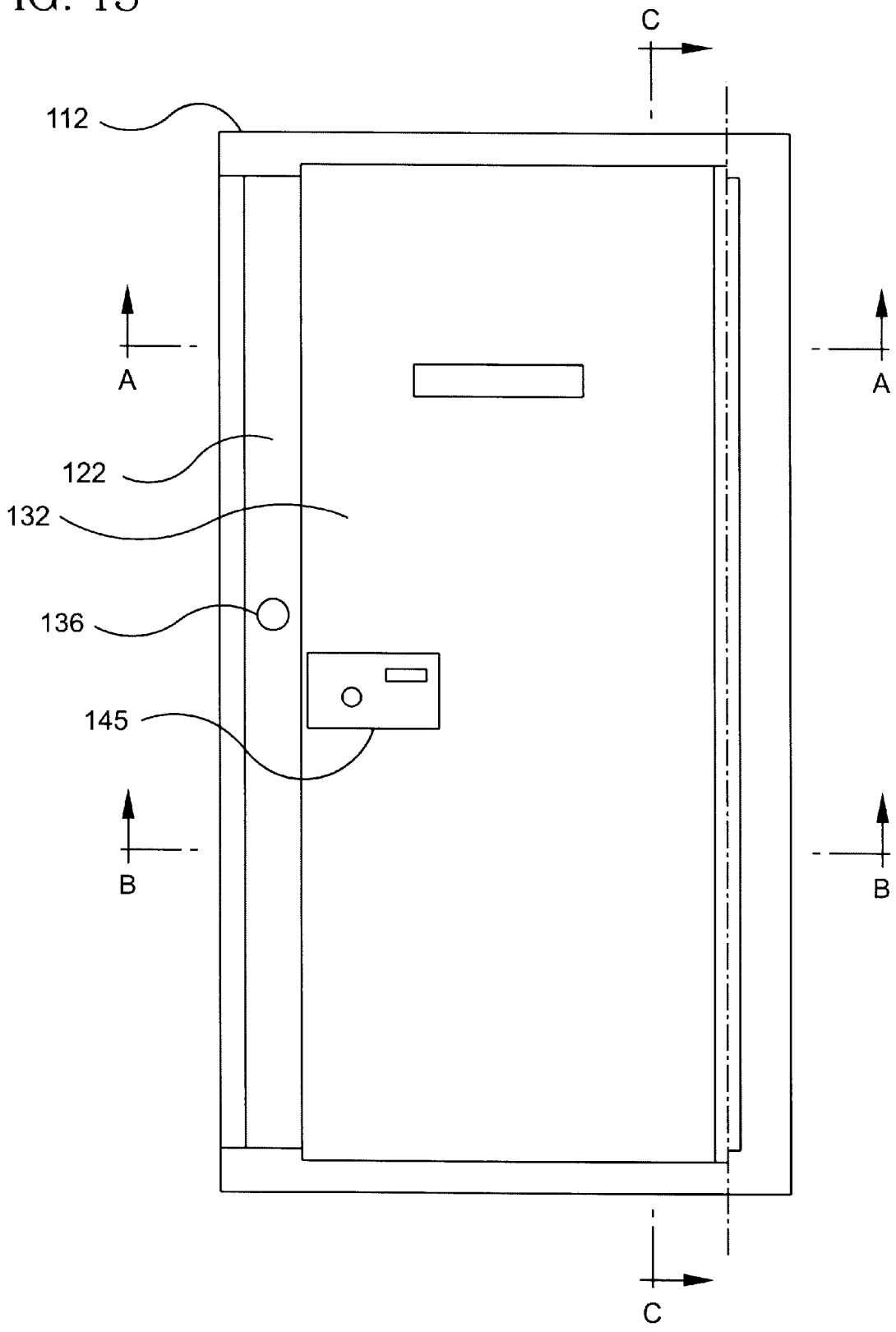
FIG. 13 is a front view of a fifth embodiment of a door according to the invention.
Figure 14A:
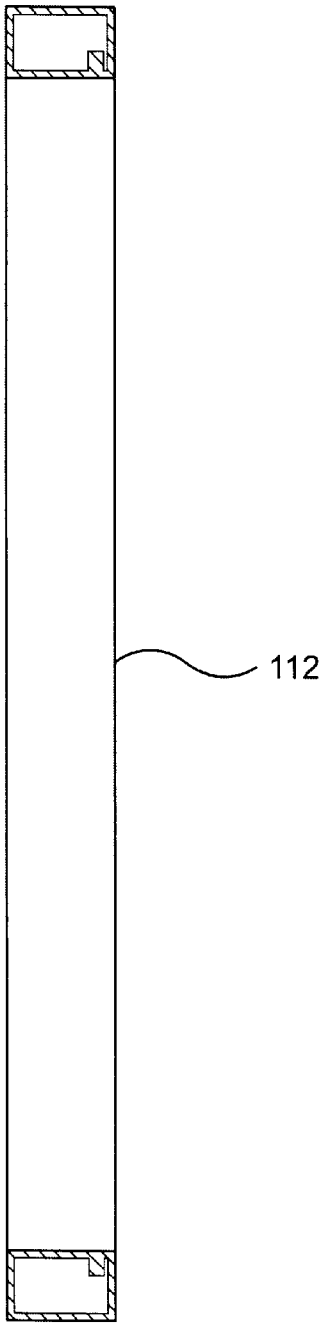
FIGS. 14, 14*a* and 14*b* are sectional side views along C—C of FIG. 13 respectively of the fixed frame portion, the movable frame portion and the door of the fifth embodiment.
Figure 14B:
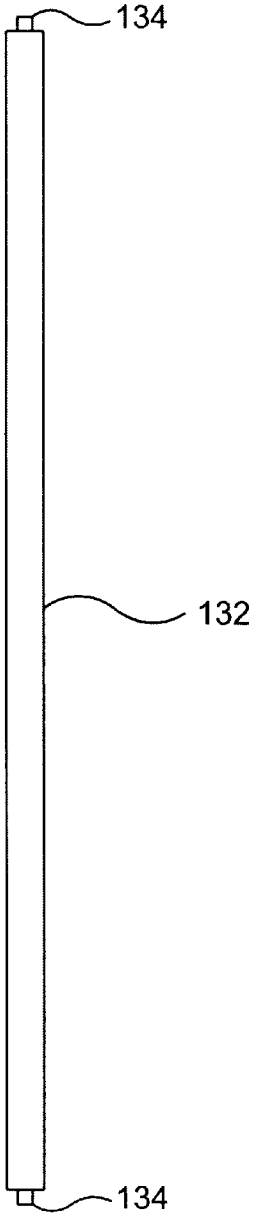
Figure 14C:
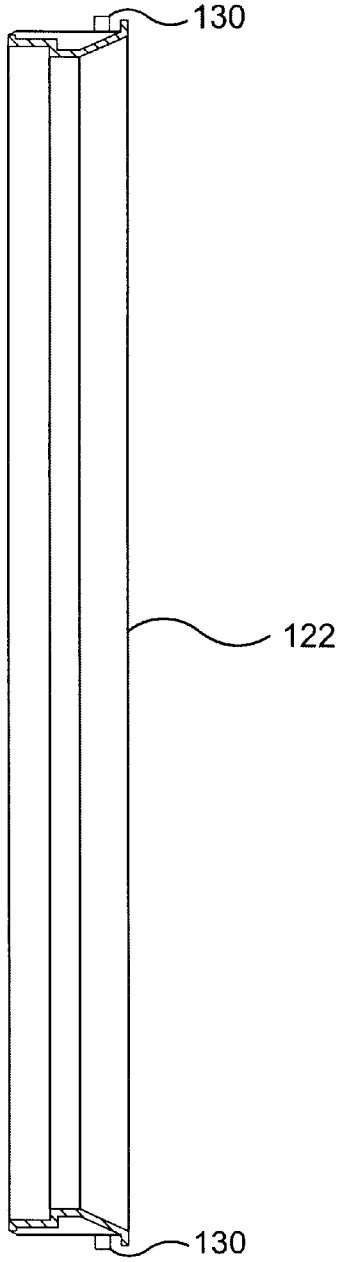
Figure 15:
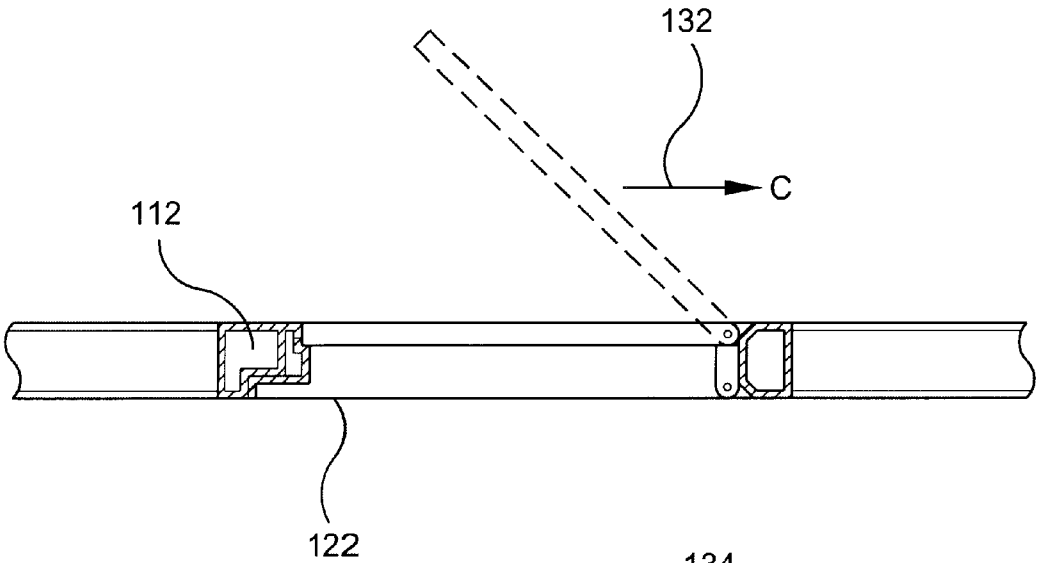
FIG. 15 is a sectional plan view along A—A of FIG. 13.
Figure 16:
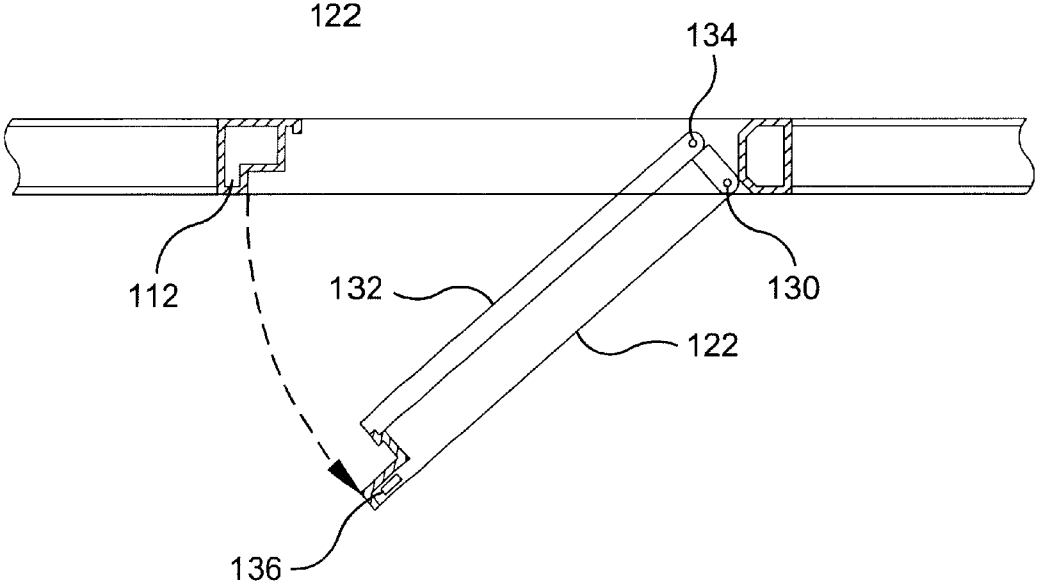
FIG. 16 is a sectional plan view along B—B of FIG. 13 in which the door opens inwards and the movable frame part opens outwards.
Figure 17:
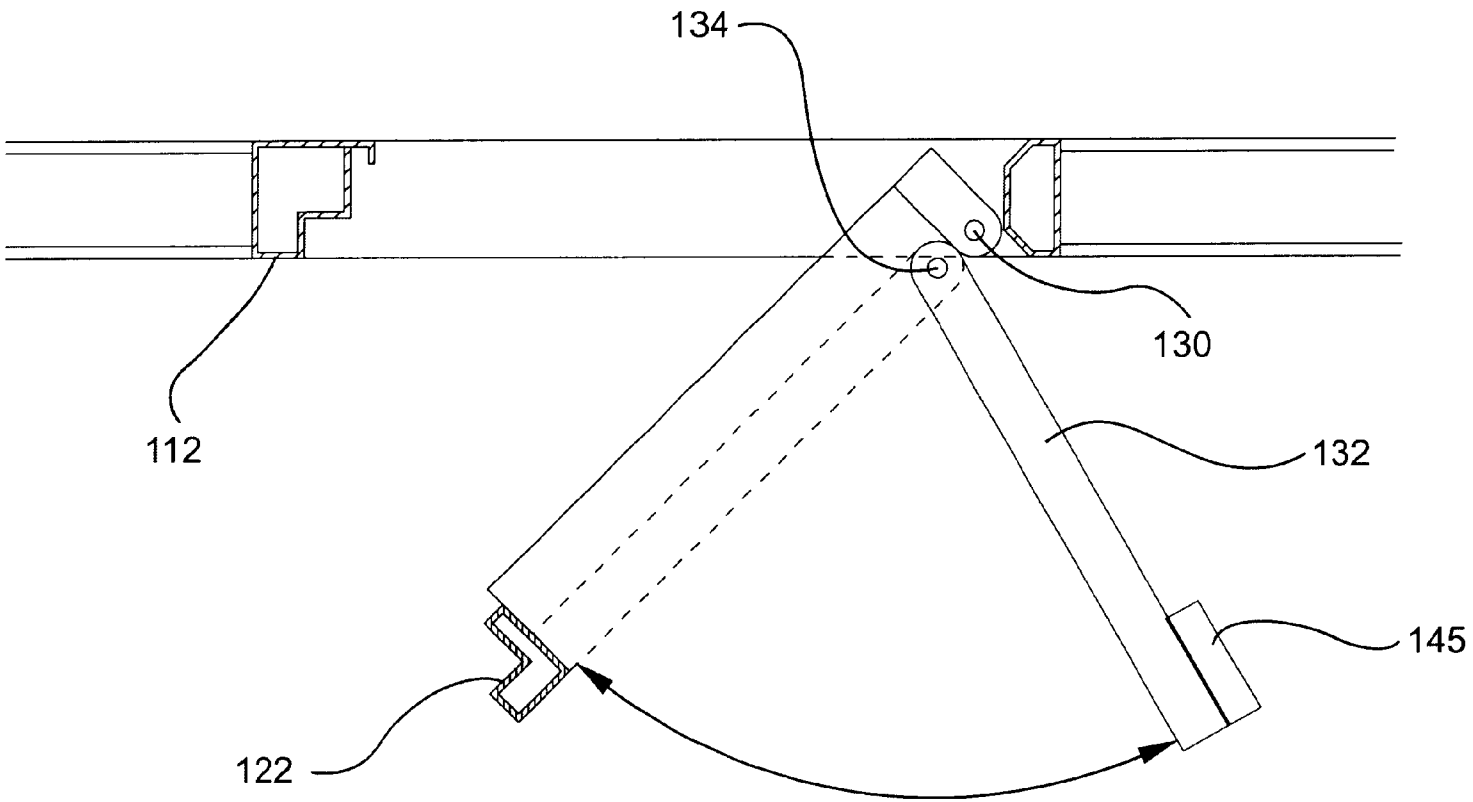
FIG. 17 is a similar view to FIG. 16 of a modification of the fifth embodiment in which the door opens outwards with the hinges of the door and movable frame part being juxtaposed.
Figure 18:
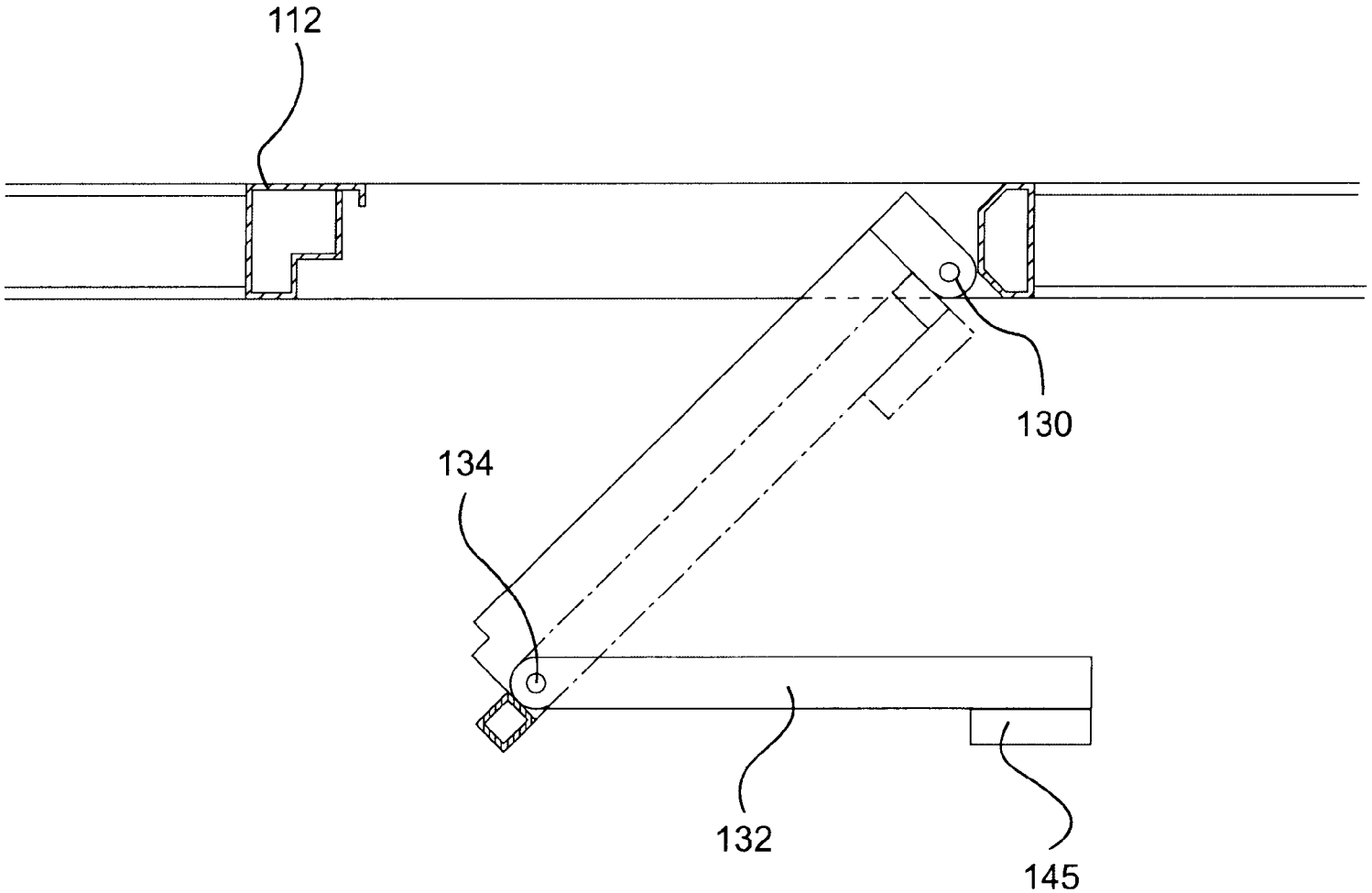
FIG. 18 is a view similar to FIG. 17, except that the hinges are at opposite sides.

In a further embodiment of the invention as shown in FIG. 11 and the respective cross sectional view of FIG. 12 the door 32*c* is hinged to the fixed frame portion 12. The hinge axis of hinges 34 is arranged so that the door 32*c* is allowed to open in both directions: outwards in an angle represented by an arrow 50 and inwards in an angle represented by an arrow 35. A removable frame portion 22*c* is arranged on the side of the custodians so that it stops the outwards movement of the door 32*c* when in a closed position. The removable frame portion 22*c* is hinged to the fixed frame portion 12 with hinges 30. The hinge axis of hinges 30 is at the outside of the frame on the side of the custodians in order to allow opening in an angle represented by an arrow 31 only.

Locking means 36 are provided to lock the removable frame portion 22*c*. Further locking means are provided to lock the door. In this particular embodiment, the locking means of the door and the removable frame portion are arranged both on the same side (left side in FIG. 11). The two sets of hinges 30, 34 are arranged on the opposite side (right side in FIG. 11) of the locks.

The hinges 30 can be fixed to the frame on the side of the custodians and the removable frame portion fixed to L-shaped connection pieces, to connect the removable frame portion 22 with the hinges 30.

The invention was herein described with door openings as an example, but it can also be applied to other openings such as windows.

The locking means 36 are quick release bolts which can have special shaped heads requiring the use of a correspondingly shaped spanner. Alternatively, the locking means can be a plurality of key-operated locks fitted along one side of the removable frame portion 22. A separate cover plate is placed over this side of the removable frame portion 22 so as to shield the locks from view.

Although not shown in the drawings a separate alarm facility may be fitted on the removable frame portion 22 and on the door 32 so as to indicate when either the removable frame portion 22 or the door 32 is open.

A separate modification is the facility to have electronic locks fitted to the door and to the removable frame portion 22 if desired.

The door 32 opens through 135 degrees as does the removable frame portion 22 but both can have the facility to open through 180 degrees by the provision of butt hinges.

The fifth embodiment is similar to the previous embodiments and includes a fixed frame portion 112, a movable frame portion 122 and a door 132. The movable frame portion 122 is hinged to the fixed frame portion 112 by hinges 130 and the door 132 is hinged to the movable frame portion 122 by hinges 134. As shown in FIGS. 15 to 18, the door 132 can be constructed so as to open inwards or outwards and the hinges 130 and 134 can be juxtaposed or at opposite sides. A lock 136 is used to secure the movable frame portion 122 to the fixed frame portion 112 and a lock 145 is used to lock the door 132 in the movable frame portion 122.

It is to be understood that the invention is not limited to the specific details described above, which are given by way of example only, and that various modification and alterations are possible without departing from the scope of the invention as defined in the appended claims.

What is claimed is:

1. A two portion frame for an opening, comprising:

(a) a fixed frame portion which is adapted to be fixedly secured about the opening;

(b) a removable frame portion which is attached to the fixed frame portion by a first set of hinges;

(c) a door which is attached to the removable frame portion by a second set of hinges, wherein the removable frame portion has a stepped profile cross section which engages the fixed frame portion when in a closed position, the first set of hinges being at an outer edge of the stepped profile cross section at a side of the fixed frame portion to which the removable frame portion opens so that the removable frame portion is moveable only outwardly from the opening, and the second set of hinges between the door and the removable frame portion being at an inner edge of the stepped profile cross section at a side of the fixed frame portion to which the door opens; and at least one spring-loaded quick release screw-threaded bolt for securing the removable frame portion to the fixed frame portion, the spring being co-axial with the screw-threaded bolt.

2. A two portion frame as claimed in claim 1, in which the removable frame portion is hinged to the fixed frame portion in a manner which allows the removable frame portion to open on said side of the fixed frame portion.

3. A two portion frame as claimed in claim 1, in which the removable frame portion is hinged to the fixed frame portion so that the removable frame portion opens only to said side of the fixed frame portion.

4. A two portion frame as claimed in claim 1, in which the door is hinged to the removable frame portion in a manner which allows the door to open in two directions.

5. A two portion frame as claimed in claim 1, in which the door is hinged to the removable frame portion wherein the side of the fixed frame portion to which the removable frame portion opens is opposite said side of the fixed frame portion to which the door opens.

6. A two portion frame as claimed in claim 1, in which at least one lock is provided to lock the door with the removable frame portion and at least one lock is provided to lock the removable frame portion with the fixed frame portion.

7. A two portion frame as claimed in claim 6, in which the door is hinged to the removable frame portion with said second set of hinges and the at least one lock to lock the door with the removable frame portion is provided on the door on a side of said door opposite the second set of hinges.

8. A two portion frame as claimed in claim 7, in which the at least one lock provided to lock the removable frame portion with the fixed frame portion is juxtaposed the lock provided to look the door with the removable frame portion.

9. A two portion frame as claimed in claim 7, in which the at least one lock provided to lock the removable frame portion with the fixed frame portion is juxtaposed the first set of hinges and the second set of hinges are juxtaposed the at least one lock provided to lock the door with the removable frame portion.

10. A two portion frame as claimed in claim 1, in which the removable frame portion is hinged to the fixed frame portion along a bottom side of the opening.

11. A two portion frame as claimed in claim 1, in which the removable frame portion extends beyond an opening in the fixed frame portion.

12. A two portion frame as claimed in claim 1, in which the removable frame portion is hinged to the fixed frame portion along a top side of the opening.

13. A two portion frame as claimed in claim 1, in which the removable frame portion is hinged to the fixed frame portion along a vertical side of the opening.

14. A two portion frame as claimed in claim 1, in which the fixed frame portion forms a portion of a wall about an opening in the fixed frame portion and the removable frame portion is hinged directly to the wall.

15. A two portion frame as claimed in claim 1, in which the side of the fixed frame portion to which the removable frame portion opens is opposite said side of the fixed frame portion to which the door opens.

* * * * *